US005465674A

United States Patent [19]

Gosche

[11] Patent Number: 5,465,674

[45] Date of Patent: Nov. 14, 1995

[54] OVEREDGE STITCH SEWING DEVICE

[75] Inventor: Matt J. Gosche, Woodstock, Ill.

[73] Assignee: Union Special Corporation, Huntley, Ill.

[21] Appl. No.: 273,774

[22] Filed: Jul. 12, 1994

Related U.S. Application Data

[63] Continuation of Ser. No. 926,755, Aug. 7, 1992, abandoned.

[51] Int. Cl.[6] ..... D05B 1/20

[52] U.S. Cl. ..... 112/162; 112/199

[58] Field of Search ..... 112/162, 199, 112/200, 202, 197, 168, 222

[56] References Cited

U.S. PATENT DOCUMENTS

| | | | |
|---|---|---|---|
| 3,398,709 | 8/1968 | Koninck | 112/162 |
| 3,881,434 | 5/1975 | Kelly | 112/199 X |
| 4,782,776 | 11/1988 | Raikov | 112/199 X |

FOREIGN PATENT DOCUMENTS

| | | | |
|---|---|---|---|
| 0212828A1 | 3/1987 | European Pat. Off. . | |
| 353208 | 1/1990 | European Pat. Off. | 112/162 |
| 672098 | 5/1956 | United Kingdom . | |
| 802833 | 5/1956 | United Kingdom . | |

OTHER PUBLICATIONS

*Union Special Catalogue: Overedge Stitch Formation Type 504*, 1978.

*Union Special Catalogue: EV–900 Class PRT–9104 Parts Manual*, Dec. 1991.

*Union Special Catalogue: Class 39500 Mark IV Single Needle Two or Three Differential Feed Overseaming Machines*, Apr. 1980.

*Union Special Catalogue: HV 200 Series Adjusting Instructions and Parts List*, Sep. 1989.

*Juki Catalogue: Overlock and Safety Stitch Industrial Sewing Machine Engineer's Manual, MO–2550N and MO–2400N Series*, Sep. 1990.

*Primary Examiner*—Clifford D. Crowder

*Assistant Examiner*—Larry D. Worrell, Jr.

*Attorney, Agent, or Firm*—Willian Brinks Hofer Gilson & Lione

[57] ABSTRACT

An overedge stitch sewing device comprising a straight sewing needle and a lower looper that travels in a curved path and has advanced timing relative to the sewing needle. The device may also contain a needle thread cam which is shaped such that the needle thread is in partial contact with the front surface of the needle thread cam during the needle stroke.

5 Claims, 7 Drawing Sheets

FIG. 2a -0°
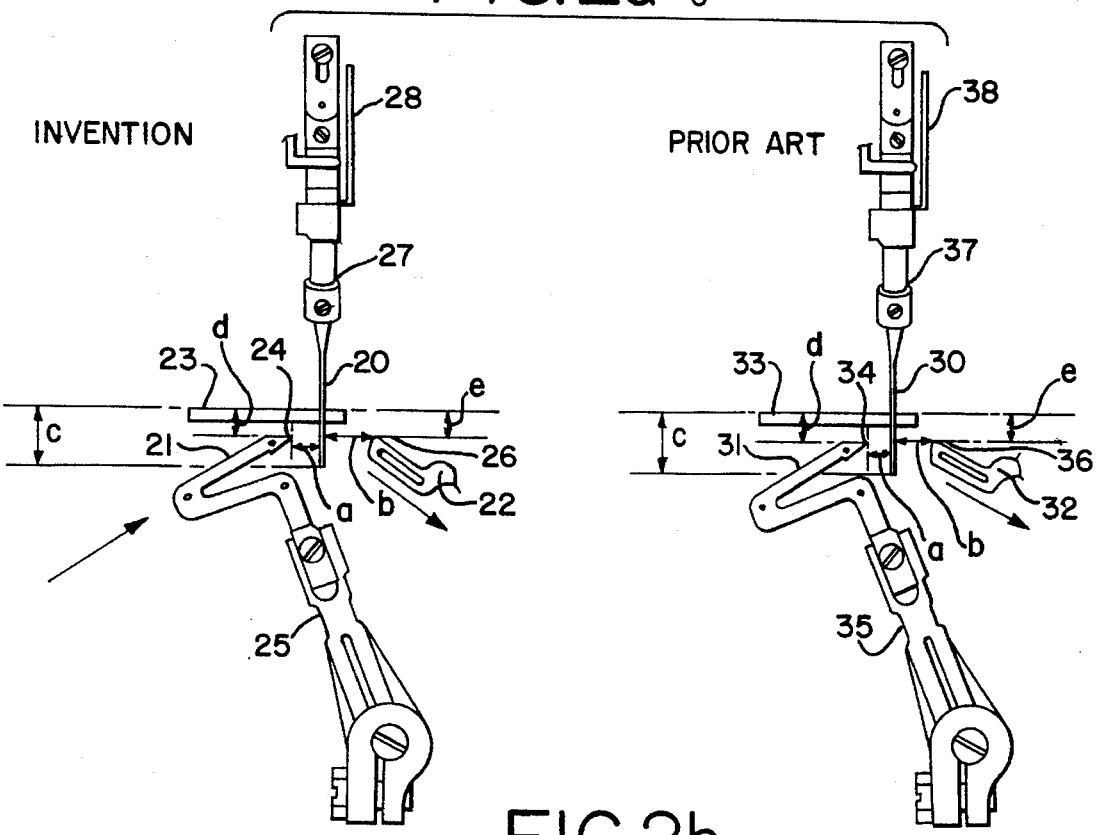
FIG. 2b -40°
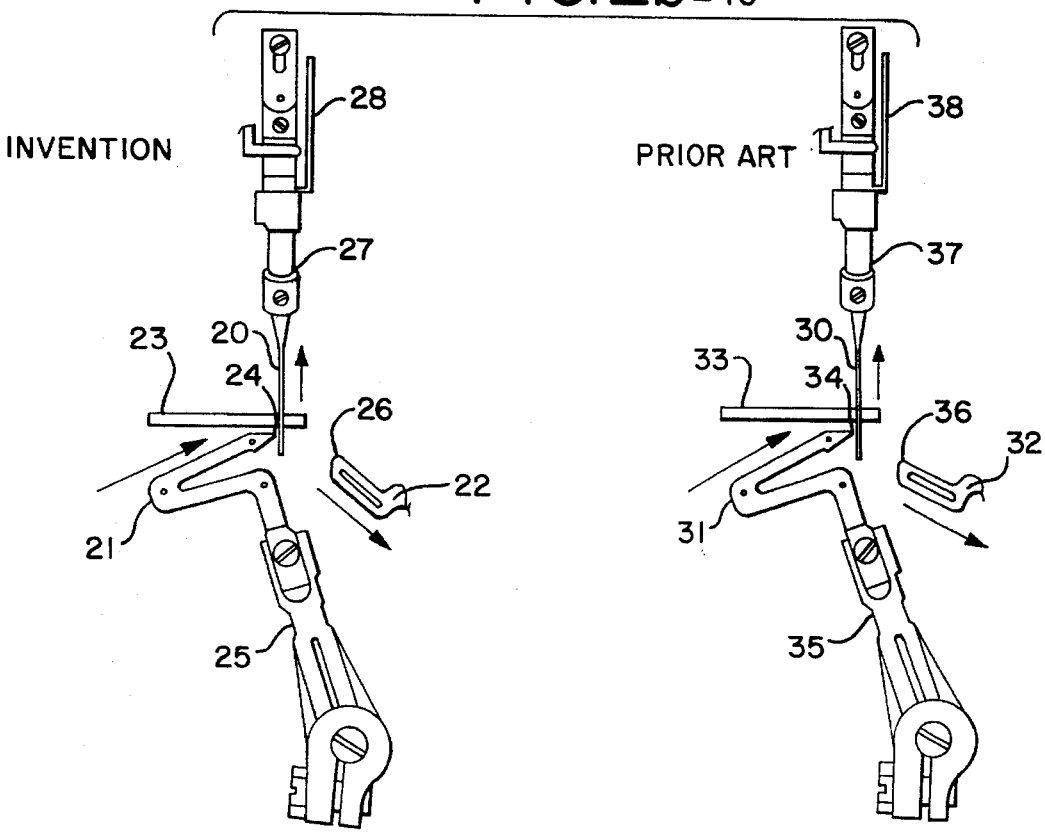

FIG. 2c -100°
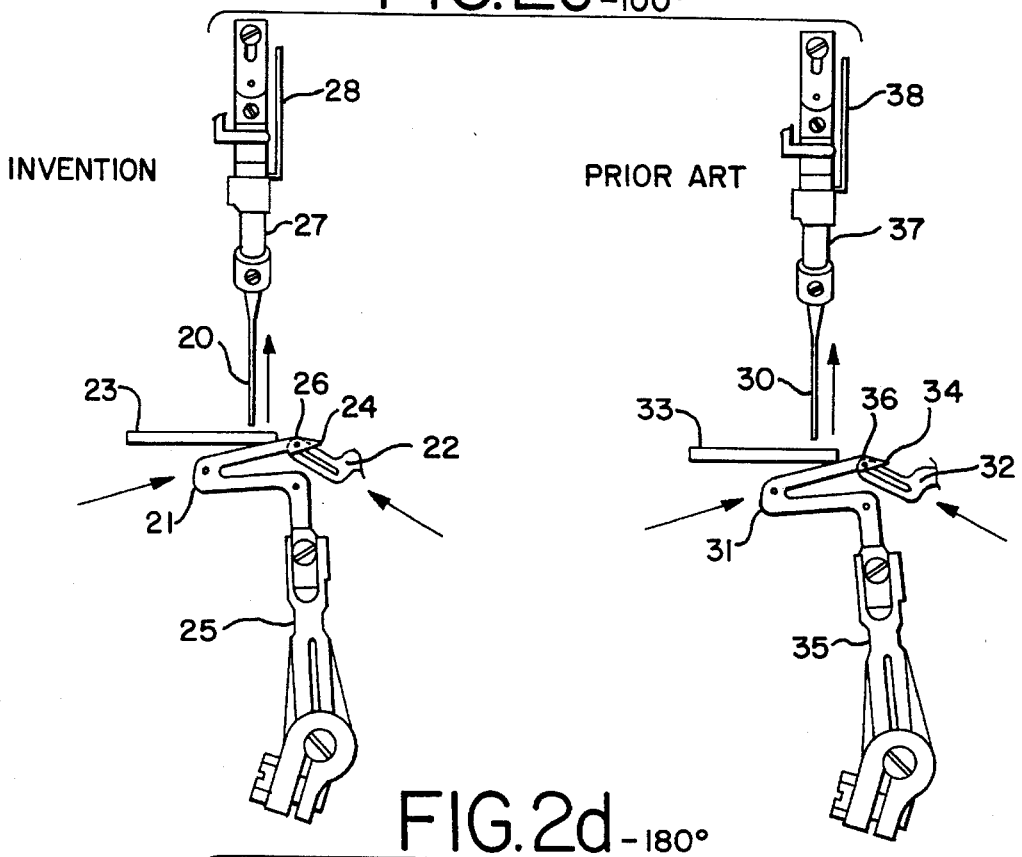
FIG. 2d -180°
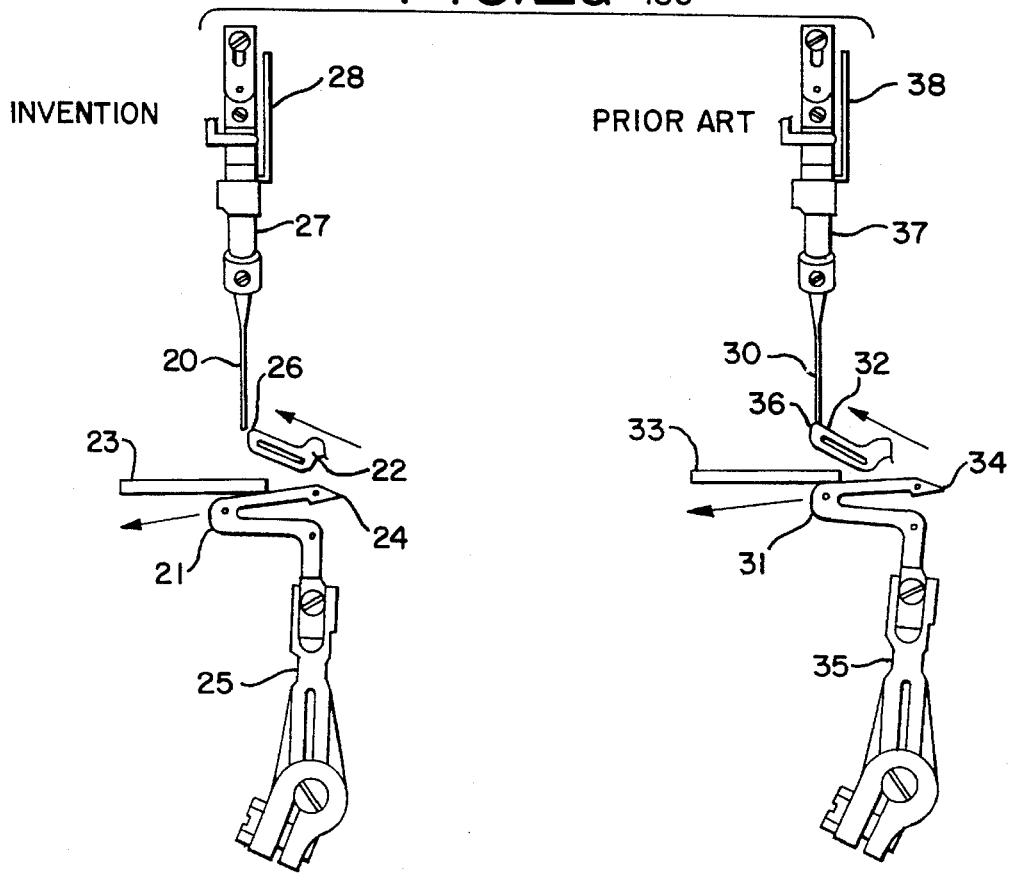

FIG. 2e -220°
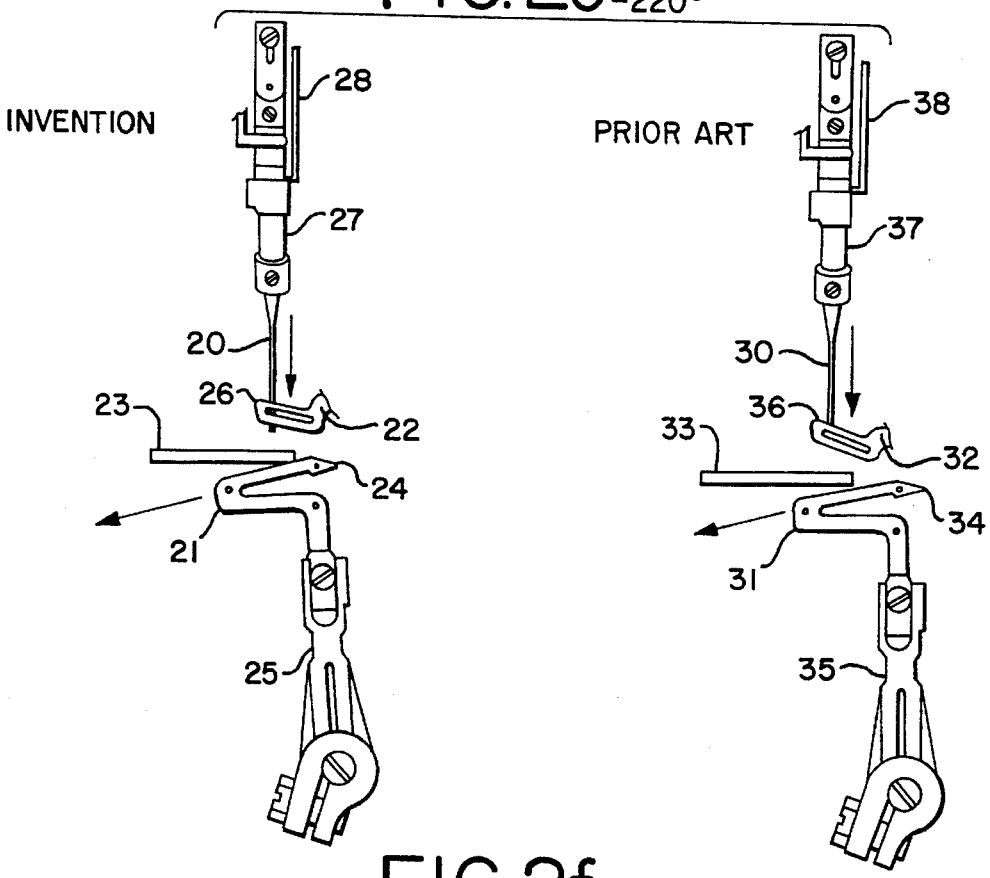
FIG. 2f -290°
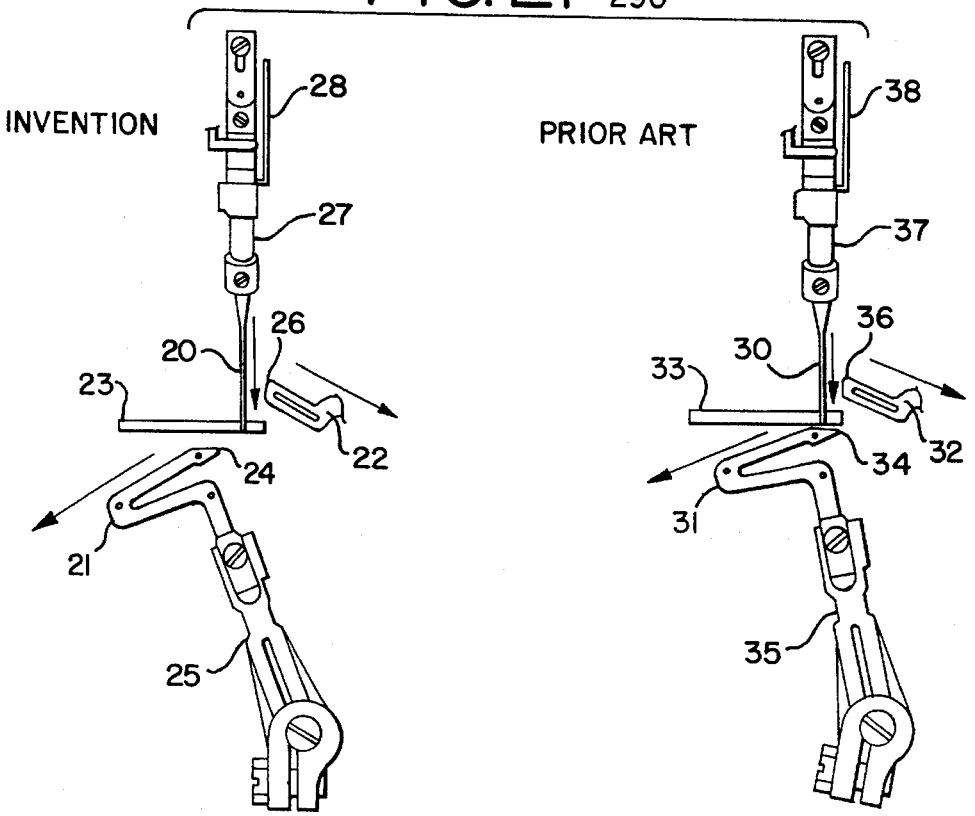

FIG. 3 -334°
INVENTION
LOWER LOOPER AT EXTREME LEFT POSITION
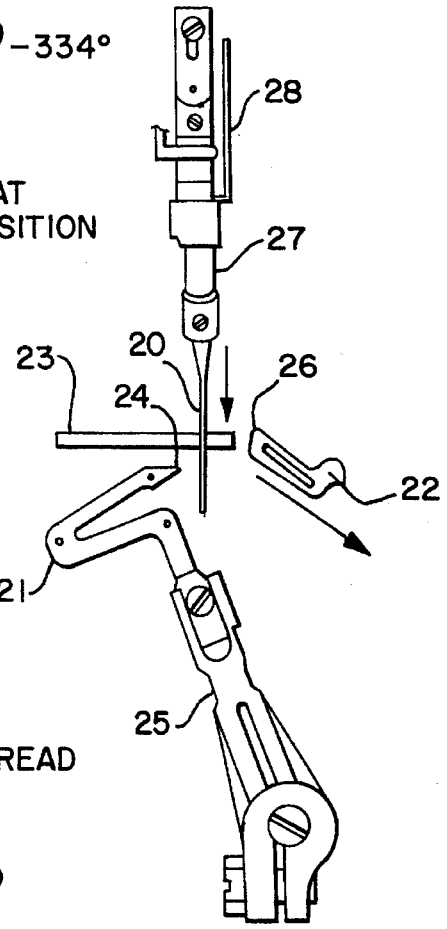
FIG. 4a
INVENTION
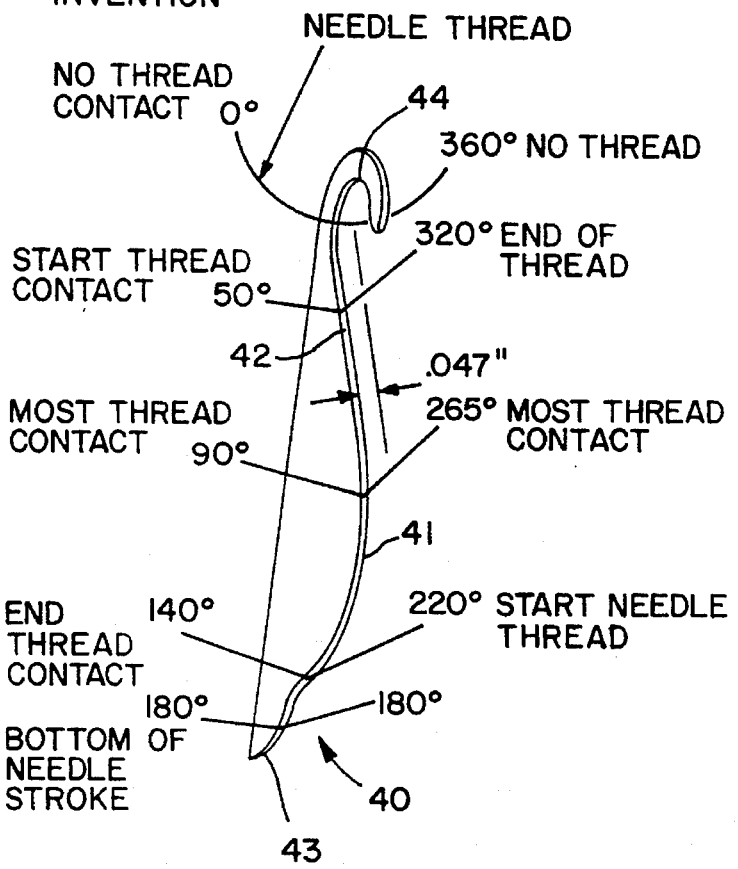
FIG. 4b
PRIOR ART
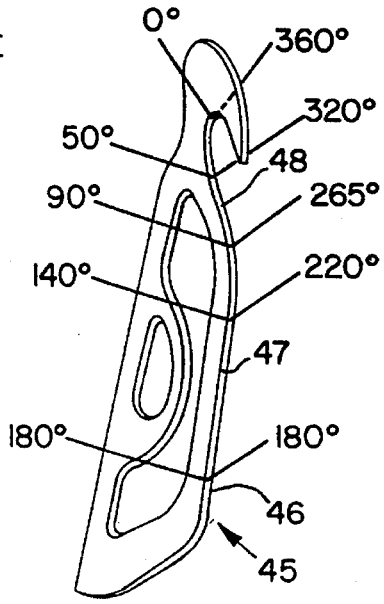

INVENTION 26° ADVANCED TIMING AT 290°

PRIOR ART SYNCHRONIZED TIMING AT 290°

OVEREDGE STITCH SEWING DEVICE

This application is a continuation of application Ser. No. 07/926,755, filed Aug. 7, 1992, now abandoned.

BACKGROUND OF THE INVENTION

This invention relates to a device for sewing an overedge stitch on a material. More particularly, this invention relates to sewing a flexible overedge seam without experiencing high thread breakage.

A goal in the sewing industry is to produce a soft and flexible overedge stitch with light tensions applied on the sewing threads during the sewing operation. The sewing industry requires the threads to produce a soft appearing overseam stitch and to accommodate the high tensions experienced in the overseaming operation. High tensions on the sewing threads cause thread breakage and increase operation downtime for thread breakage repair. However, the industry has sought to reduce needle thread tension experienced in the overseaming operation because knit manufactures sometimes require that certain weak knitting yarns, such as texturized polyester, be used for sewing threads. In addition, light needle thread tensions reduce or eliminate needle deflection caused by excessive needle thread tensions. The industry also seeks a soft, flexible chain because it eliminates the need for mechanical aids to provide flexibility in a latch tacking operation. Also, a flexible chain moves easily into a chain trimmer without hang-up, is less likely to unravel, and is more durable.

A flexible overedge seam sewn into a material should have a tight needle thread and relaxed upper and lower looper threads. A flexible chain is produced by the upper and lower looper threads setting on the edge of the stitch tongue before the needle thread sets. This results in the needle thread wrapping around the stitch tongue after the looper threads are set. When not sewing in a material, the needle thread length in the overedge stitch is approximately the same as the length of the upper and lower looper threads when the chain is stretched out. However, when sewing an overseam into a material, the needle thread sets slightly before the lower looper thread causing the needle thread to become pulled up by the needle thread cam and remain tight in the seam.

Three prior art devices for sewing an overedge stitch or an overseam are the Union Special Class 39500, HV 200 series and Class EV-900 sewing machines, and the Juki MO-2500N and MO-2400N series sewing machines. The Union Special 39500, which was the first overedge stitch machine, employs a curved sewing needle and a lower looper that travels in a straight direction. The timing of the lower looper with respect to the curved sewing needle is advanced 30° and the needle thread is in partial contact with the needle thread cam 75% of the time during the needle stroke. However, the Union Special 39500 sewing needle is expensive because it is very costly to manufacture a curved needle in comparison to a straight needle.

The Union Special HV 200 series overedge sewing machine, which was developed after the Union Special 39500, employs a straight sewing needle, and a lower looper with a 20° advanced timing with respect to the needle. The lower looper travels in a straight path and the needle thread cam contacts the needle thread approximately 80% of the time during the needle stroke. While the straight needle eliminates the expense of machining a curved needle, the Union Special HV 200 series machine has a tendency to produce a malform stitch because of the 20° advanced timing.

More recently, the Juki MO-2500N and MO-2400N series sewing machines, as well as the Union Special Class EV-900 sewing machines, have been used for performing overseaming operations. These machines contain a straight sewing needle and a lower looper with a synchronized timing with respect to the sewing needle. The lower looper travels in a curved path and the needle thread contacts the needle thread cam substantially 100% of the time during the needle stroke. This design suffers from high needle thread breakage because of the high friction caused by the synchronized timing and the 100% contact of the needle thread with the needle thread cam.

SUMMARY OF THE INVENTION

The invention is an overedge stitch sewing device comprising a straight sewing needle and a lower looper that travels in a curved path and has advanced timing relative to the sewing needle. In another embodiment, the invention further comprises a needle thread cam which is shaped such that the needle thread is in partial contact with the front surface of the needle thread cam during the needle stroke.

BRIEF DESCRIPTION OF THE DRAWINGS

FIG. 2(*a*)–2(*f*) compare one embodiment of the invention with 26° advanced timing to a prior art overseam sewing machine employing synchronized timing.

FIG. 3 depicts one embodiment of the invention with 26° advanced timing where the lower looper is at the extreme left hand position.

FIGS. 4(*a*)–4(*b*) illustrates a needle thread cam of the invention and a needle thread cam used in the prior art overseam sewing machine depicted in FIG. 2.

DETAILED DESCRIPTION OF THE DRAWINGS AND PREFERRED EMBODIMENTS

While the invention pertains to the use of advanced timing, preferably, the timing of the lower looper is advanced about 15° to 35° with respect to the sewing needle, and most preferably, about 26°. The timing range is believed to be limited by the capacity of material being sewn and the thickness of seams.

The invention allows an operator to reduce the tension settings on the needle thread about 50% as compared to prior art overseaming machines. The exact amount of tension applied to the needle thread when the invention is used depends upon the strength and size of the thread and the exact sewing operation. However, a typical needle thread tension for use in the invention ranges from about 0.4 to 1.5 ounces as measured by a Chatillon DPP-16 spring pull tension gauge.

The invention may be used for any overseam type stitch, such as the Type 504 stitch, or for stitches made with multiple sewing needles and loopers. There is no limitation on the type of thread that can be used with the invention. Typical threads include texturized polyester, such as size T 18, core spun polyester, spun polyester, cotton and blended threads.

The sewing needle may be any straight design and preferably ranges in size between about 65/025 to 100/040. The upper looper and lower looper designs are typical to that shown in the figures, but the lower looper design may need modification to provide clearance for the differential feed dog, because the lower looper gauge sets the lower looper 0.094 inches (2.4 mm) more to the left than the standard setting. Finally, the main feed dog and the differential feed dog may require a split behind the needle for a clearance of about 0.141 inches for sewing knit material.

The invention can be used with a needle thread cam designed for only partial contact with the needle thread during the needle stroke. The exact cam design and amount of contact depends upon the thread tension, machine settings, and sewing operation. Preferably, the needle thread cam contacts the needle thread in the range of 35% to 55% of the time during the needle stroke, and most preferably, about 47% of the time at an advanced timing setting of 26°.

The invention provides several advantages over the prior art, including: a better balance in sewing thread tensions; reduced needle thread tension to reduce thread breakage; increased looper thread tension for increased control of the sewing operation; overall reduction in friction, and thus tension, experienced by the needle thread providing better control; a soft and flexible overedge stitch; increased consistency in overedge stitch formation; easier lower looper threading to both looper eyes because the lower looper setting is positioned farther to the left than in the prior art; elimination of a curved needle; and reduced needle heat because the sewing needle travels less distance through the throat plate. These advantages will be apparent in view of the following description of preferred embodiments.

Figure 1:
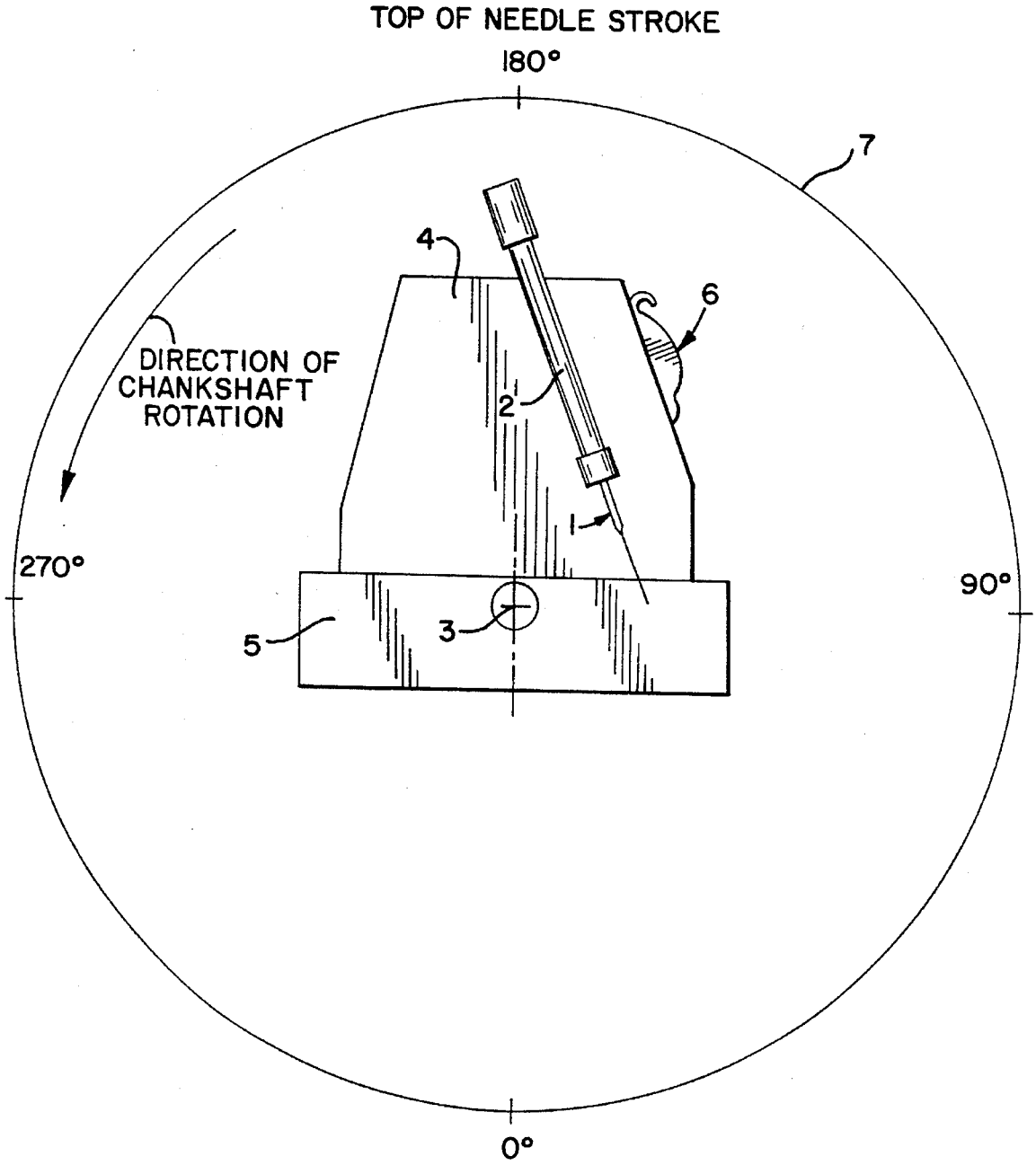
FIG. 1 is a side illustration of portions of one embodiment of the overedge stitch sewing device.

FIG. 1 shows a needle drive and cam assembly from a side perspective comprising a straight needle 1 held by a needle head 2 which is mechanically linked to a driving mechanism (not shown). The driving mechanism is shielded by covers 4 and 5 in this illustration for the sake of simplicity and can be any mechanism commonly known in the art. A needle cam 6 which guides the thread to the needle is positioned above the sewing needle 1. FIG. 1 shows the needle 1 at the bottom of the needle stroke, which is the down or 0° position. The top of the needle stroke is the 180° position. A circle 7 is superimposed over the needle drive and cam assembly to indicate the direction of rotation of the crankshaft 3.

FIGS. 2(*a*) through 2(*f*), which are not to scale, compare the invention to a Juki MO type overseaming machine at the 0°, 40°, 100°, 180°, 220°, and 290° needle stroke positions, respectively. The figures illustrate the two machines from a front perspective in order to show the timing differences in the lower looper relative to the sewing needle. The invention depicted in FIGS. 2(*a*)–(*f*) contains a straight sewing needle 20, a lower looper 21, having a blade point 24, and an upper looper 22, having a blade point 26. The lower looper 21 travels in a curved path and is attached by a screw to a looper holder 25, which is mechanically linked to a crankshaft (not shown). The upper looper 22 is also mechanically linked to the crankshaft. The crankshaft employed in the invention is shown in greater detail in FIG. 7. A sewing needle 20 is attached by a screw to a needle clamp 27, which is also mechanically driven by the crankshaft. The needle 20 reciprocates through slots (not shown) of a throat plate 23. A needle thread cam 28, which is illustrated in greater detail in FIG. 4(*a*), is located above the sewing needle 20.

The prior art Juki MO type overseaming sewing device depicted in FIGS. 2(*a*)–(*f*) contains a straight sewing needle 30, and a lower looper 31, having a blade point 34, and upper looper 32, having a blade point 36. The lower looper travels in a curved path and is attached by a screw to a looper holder 35, which is mechanically linked to a crankshaft (not shown). The upper looper 32 is also mechanically linked to the crankshaft. The sewing needle 30 is attached by a screw to a needle clamp 37 which is mechanically driven by a crankshaft (not shown). The needle thread 30 reciprocates through slots (not shown) of a throat plate 33. A needle thread cam 38, which is illustrated in greater detail in FIG. 4(*b*), is located above the sewing needle 30.

FIG. 3 depicts the invention where the lower looper 21 is at the extreme left hand position of its stroke. The lower looper setting is determined when the lower looper is at the extreme left hand position of its stroke. FIG. 4 illustrates a needle thread cam 28 of the invention 4(*a*) and a needle thread cam 38 used in the prior art Juki MO type overstitch sewing machine 4(*b*). FIGS. 4(*a*) and 4(*b*) show the approximate needle thread locations on the needle thread cam during a needle stroke. FIG. 4(*a*) shows that in the invention needle thread contact with the cam occurs during a portion of the needle stroke, and approximately 50% of the time during a needle stroke when the timing of the lower looper is 26° advanced relative to the needle stroke. In comparison, FIG. 4(*b*) shows that needle thread contact with the cam occurs 100% of the time during a needle stroke when synchronized timing is employed.

In the context of this invention, synchronized timing means that at the 0° position of the needle stroke, the sewing needle is located at the down position of its stroke and the lower looper is located at the extreme left hand position of its stroke. Thus, with respect to the prior art device shown in FIG. 2(*a*), at the 0° position, the sewing needle 30 is located at the bottom of the needle stroke and the lower looper 31 is at its extreme left hand position of its stroke.

Advanced timing means that at the 0° position of the needle stroke, the sewing needle is located at the down position of its stroke and the lower looper is located to the right of the extreme left hand position in its stroke. Thus, with respect to the invention shown in FIG. 2(*a*), at the 0° position, the sewing needle 20 is located at the bottom of the needle stroke, and the lower looper 21 is located to the right of the extreme left hand position, and is advanced a distance toward the sewing needle 20. In the embodiment for the invention shown in FIG. 2(*a*), the lower looper has a 26° advanced timing with respect to the sewing needle. Accordingly, at 0° the lower looper 21 is located 0.045 inches to the right of its extreme left hand position and is travelling toward the sewing needle 20 as indicated by the directional arrow.

Table 1 lists various dimensions between the sewing needle, the upper looper, the lower looper and the top surface of the throat plate for the needle stroke positions illustrated in FIGS. 2(*a*)–(*f*) and 3. The distance between the blade point 24 (invention), 34 (prior art) of the lower looper 21, 31 and the centerline of the sewing needle 20, 30 is indicated in FIG. 2 by the letter "a." The distance "a" is known as the lower looper setting or the returning amount of the lower looper when the lower looper is at the extreme left hand position of its stroke. The distance between the blade point 26, 36 of the upper looper 22, 32 and the centerline of the sewing needle 20, 30 is indicated in FIG. 2 by the letter "b." The distance between the top surface of the throat plate 23, 33 and the bottom tip of the sewing needle 20, 30 is indicated in FIG. 2 by the letter "c." The distance between the flat top surface of the lower looper 21, 31 and the top surface of the throat plate 23, 33 is indicated in FIG. 2 by the letter "d." Finally the distance between the blade point 26, 35 of the upper looper 22, 32 and the top surface of the throat plate 23, 33 in FIG. 2 is indicated by the letter "e." The distance "e" is know as the upper looper setting or the height of the upper looper when the upper looper is in the extreme right hand position of its stroke.

The blade points 24 and 34 of the lower loopers 21 and 31 enter the scarves of the respective sewing needles 20 and 30 at the 40° position (FIG. 2(*b*)). At the 100° position, the blade points 26 and 36 of the upper loopers 22 and 32 enter the triangle of thread formed by the lower looper picking up the needle thread (FIG. 2(*c*)).

Between the 0° and the 180° positions, the sewing needles 20 and 30 are travelling upward. At the 180° position (FIG. 2(*d*)), the sewing needles 20 and 30 reach the top of their respective strokes, and thereafter travel downward. At this point the sewing needle 20 of the invention is 0.468 inches (dimension c) above the top surface of the throat plate 23,

TABLE 1

Dimension Comparison Between The Invention And The Prior Art Through 360° Of The Needle Stroke (inches)[1]

| STROKE | DIMENSION | a | b | c | d | e |
|---|---|---|---|---|---|---|
| 0° | Invention | −.187(l) | −.375(r) | −.468 | −.187(l) | −.187(r) |
| FIG. 2a | Prior Art | −.156(l) | −.312(r) | −.500 | −.187(l) | −.250(r) |
| 40° | Invention | 0 | −.375(r) | −.375 | −.125 | −.312(r) |
| FIG. 2b | Prior Art | 0 | −.312(r) | −.468 | −.125 | −.375(r) |
| 100° | Invention | −.531(r) | −.312(r) | +.060 | −.032(r) | −.060(r) |
| FIG. 2c | Prior Art | −.531(r) | −.250(r) | +.060 | −.040(r) | −.093(r) |
| 180° | Invention | .781(r) | 0 | +.468 | 0(r) | +.468 |
| FIG. 2d | Prior Art | −1.000(r) | +.032(l) | +.393 | −.032(r) | +.437(l) |
| 220° | Invention | −.531(r) | +.156(l) | +.375 | −.032(r) | +.437(l) |
| FIG. 2e | Prior Art | −.812(r) | +.156(l) | +.250 | −.032(r) | +.437(l) |
| 290° | Invention | −.125(l) | +.250(r) | −.125 | −.125(l) | +.344(r) |
| FIG. 2f | Prior Art | −.171(r) | +.187(r) | −.218 | −.100(r) | +.250(r) |
| 334° | Invention | −.250(l) | .312(r) | −.437 | −.218(l) | 0(r) |
| FIG. 4 | | | | | | |

1. A negative (−) symbol indicates that the point of measurement is from below the top surface of the throat plate 23, 33; a plus symbol (+) indicates that the point of measurement is from above the top surface of the throat plate 23, 33. The symbol (l) indicates that the point of measurement is from the left of the sewing needle 20, 30; and the symbol (r) indicates that the point of measurement is from the right of the sewing needle 20, 30.

Figure 5A:
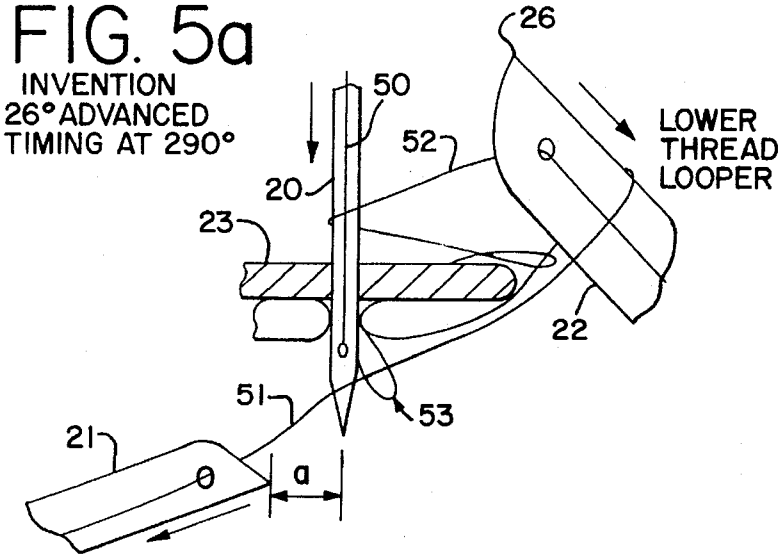
FIGS. 5(*a*)–5(*b*) compare one embodiment of the invention with 26° advanced timing to a prior art overseam sewing machine at a 290° position in the needle stroke.
Figure 5B:
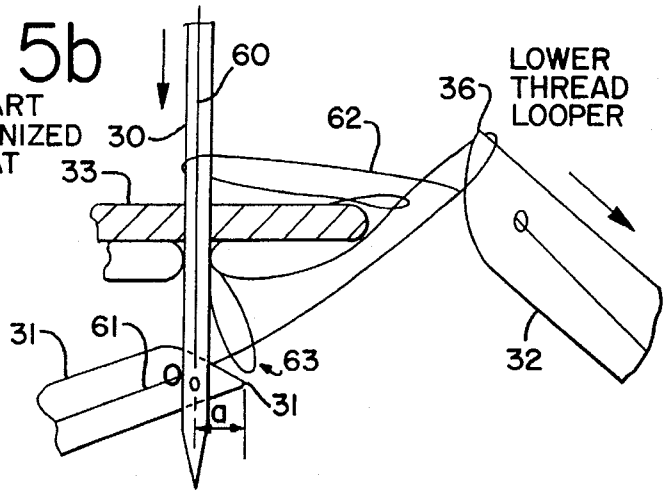

Table 1 and FIGS. 2–4, illustrate one embodiment of the invention, where the timing of the lower looper 21 relative to the sewing needle 20 is advanced 26°, and a prior art Juki MO type sewing device, where the timing of the lower looper 31 and the sewing needle 30 is synchronized. The arrows in FIGS. 2 and 4 indicate the direction of travel for the sewing needle, the lower looper and the upper looper at the illustrated position. No arrow is present if a particular component is at an end point in its stroke. Those skilled in the art understand that a needle thread, upper looper thread and lower looper thread are used in a normal sewing operation, as depicted in FIG. 5. However, the threads do not appear in FIGS. 2 and 3 to more easily illustrate the relationship between the sewing needle, lower looper and upper looper during the needle stroke cycle. A comparison of one needle stroke cycle illustrates advantages of the invention over the prior art.

At the approximate 0° position shown in FIG. 2(*a*), the lower looper 21 of the invention is located about 0.045 inches to the right of its extreme left hand position and is moving toward the sewing needle 20. In contrast, the lower looper 31 of the prior art is at its extreme left hand position. Table 1 shows that at the 0° position the lower looper 31 of the prior art is 0.156 inches (dimension "a") to the left of the sewing needle 30, which is the suggested lower looper setting for the Juki MO type overseaming machine. On the other hand, the extreme left hand position for the lower looper 21 of the invention occurs when the sewing needle 20 is at the 334° position. (See FIG. 4.) At this position, Table 1 shows that the lower looper is 0.250 inches to the left of the sewing needle 20.

and the sewing needle 30 of the prior art is 0.393 inches above the top surface of the throat plate 33. (See Table 1.) At the 180° position, the dimension indicated by the letter "c" is also known as the standard needle setting.

FIG. 2(*e*) shows the invention and the prior art at the 220° position of the needle stroke. At this point, the upper looper 22, 32 is at the extreme left hand position of its stroke, and the blade point 24, 34 of the lower looper 21, 31 is to the right of and moving toward the sewing needle 20, 30. However, because of the advanced timing in the invention, the blade point 24 of the lower looper 21 is 0.531 inches from the sewing needle's path of reciprocation, and is closer to the centerline of the sewing needle 20 at 220° than the blade point 34 of the lower looper 31 in the prior art, which is 0.812 inches away. (See dimension "a" in Table 1.) At 290° (FIG. 2(*f*)), the blade point 24 of the lower looper 21 of the invention is past the reciprocation plane of the needle and is 0.125 inches to the left of the centerline of the needle 20. In contrast, the blade point 34 of the lower looper 31 of the prior art is 0.171 inches to the right of the centerline of the sewing needle 30. (See dimension "a" in Table 1.)

FIG. 5, which is also not to scale, shows the sewing needle and lower looper relationship in greater detail than FIG. 2(*f*) at 290° rotation, and compares the relationship of these components when the needle thread releases off the lower looper and the stitch begins to set. In FIG. 5(*a*), the sewing needle 20 and needle thread 50 have entered the upper triangle formed by the upper looper thread 52 and have penetrated the sewing material (not shown). The lower looper 21 is positioned 0.125 inches to the left of the sewing needle 20 and travelling to the left. The needle loop 53 has already released from the lower looper 21.

FIG. 5(*b*) depicts a needle thread 60, lower looper thread 61 and upper looper thread 62 at 290° rotation as the stitch is beginning to set. In comparison to FIG. 5(*a*), because the lower looper 31 and needle 30 are synchronized, the lower looper 31 is positioned 0.171 inches to the right of the sewing needle 30 and is travelling to the left as the needle loop 63 releases from the lower looper 31.

An advantage of the invention can be seen in FIG. 4, which compares needle thread contact with a needle thread cam of the invention (FIG. 4(*a*)) and a needle thread cam used on the prior art Juki MO type overseaming machine (FIG. 4(*b*)) at several degrees of rotation in the needle stroke. In FIG. 4(*a*), the needle thread contacts the needle thread cam approximately 50% of the time during the needle stroke, or between about the 50° and 140° positions and again between about the 220° and 320° positions. The invention allows the needle thread to contact the needle thread cam only partially during the needle stroke, because the invention provides increased control of the needle thread. As a result, friction, and therefore tension on the thread, is reduced with reduced thread contact, and this allows thinner, weaker and less expensive threads to be employed in a sewing operation. The reduction in thread contact achieved will depend on the type of thread being sewn. While any reduction in thread contact is advantageous, preferably the needle thread contacts the needle thread cam about 40 to 60% of the time during the needle stroke.

The invention contemplates any needle thread cam contact design or shape that allows partial thread contact, but the design may vary with the type of thread used. FIG. 4(*a*) depicts a needle thread cam 40 that can be used with the embodiment of the invention shown in FIG. 2. The needle thread cam 40 has an expanded center portion 41, an upper gradually tapered portion 42 and a lower tapered portion 43 that has no needle thread contact and slopes greater than the upper tapered portion. The tapered portions accommodate the reduced contact of the needle thread with the needle thread cam. For a cotton thread a slight thread bow exists in the upper tapered portion 42. However for texturized polyester, core spun and spun polyester threads, a gap of about 0.047 inches is present between a line drawn outward from the inside center of hook portion 44 and a tangent to the outside surface of the upper tapered portion 42.

In contrast, the prior art needle thread cam 45, which is used by the Juki MO type overseaming machine shown in FIG. 2, contacts the needle thread substantially 100% of the time during the needle stroke. The needle thread cam 45 has an expanded lower portion 46, an expanded center portion 47 and an upper portion 48 that is sharply biased.

Figure 6:
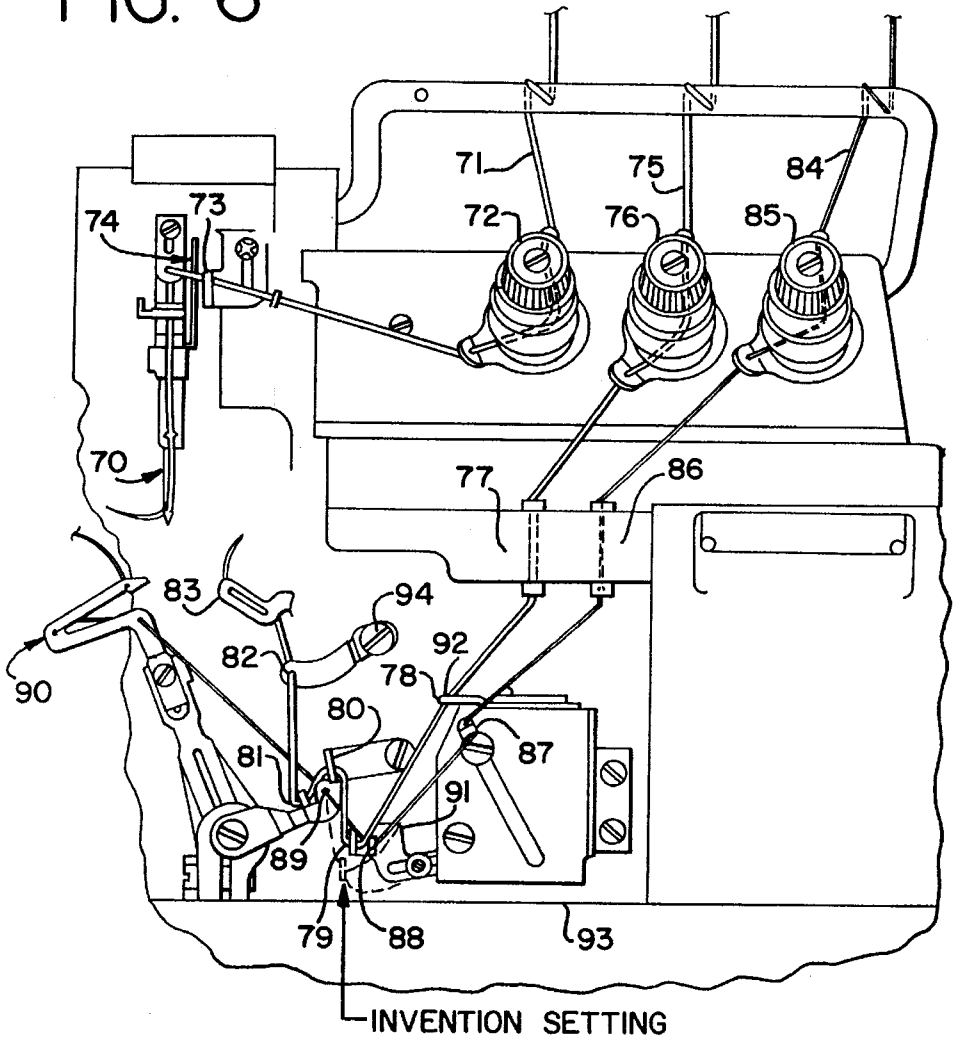
FIG. 6 illustrates thread settings for one embodiment of the invention.

FIG. 6 depicts a threading diagram and control settings for one embodiment of the invention having a single sewing needle 70. The needle thread 71 is threaded through a tension disc 72, an eyelet 73, a needle thread cam 74 and then the needle 70. The upper looper thread 75 is threaded through a tension disc 76, a portion of the housing 77, a first upper looper thread guide 78, a thread take-up 79, eyelets 80 and 81, a second upper looper thread guide 82 and an upper looper 83. The lower looper thread 84 is threaded first through a tension disc 85, a portion of the housing 86, lower looper thread guide 87, a thread take-up 88, eyelet 89 and lower looper 90.

For the embodiment of the invention employing 26° advanced timing, the setting of the thread take-up 88 for the lower looper thread 84 is indicated by the broken line. The settings for the invention are lower than the standard settings would be for a Juki MO prior art machine. The lower settings draw more thread from the thread cone and thus help produce a softer appearing stitch in the seam. A typical setting for the embodiment described would be to set the lower looper thread guide eyelet 87 high and the lower looper thread take-up 88 at 19 mm for cotton thread and 23 mm for other threads, such as texturized polyester, core spun and spun polyester, from point 91. For upper looper threading, the first upper looper thread guide 78 is set at 23 mm for cotton and 18 mm for other thread from point 92; the thread take-up 79 is set at 17 mm for cotton and 12 mm for other thread from point 93; and the second upper looper thread guide 82 is set at 22.5 mm from point 94 and 64 mm from point 93. For the needle threading, the needle thread take-up guide is set at 74.5 mm, with an eyelet height of 75.0 mm, from the throat plate (not shown). It is to be understood that these and other settings can be adjusted in accordance with the type of thread employed and the sewing conditions.

Figure 7:
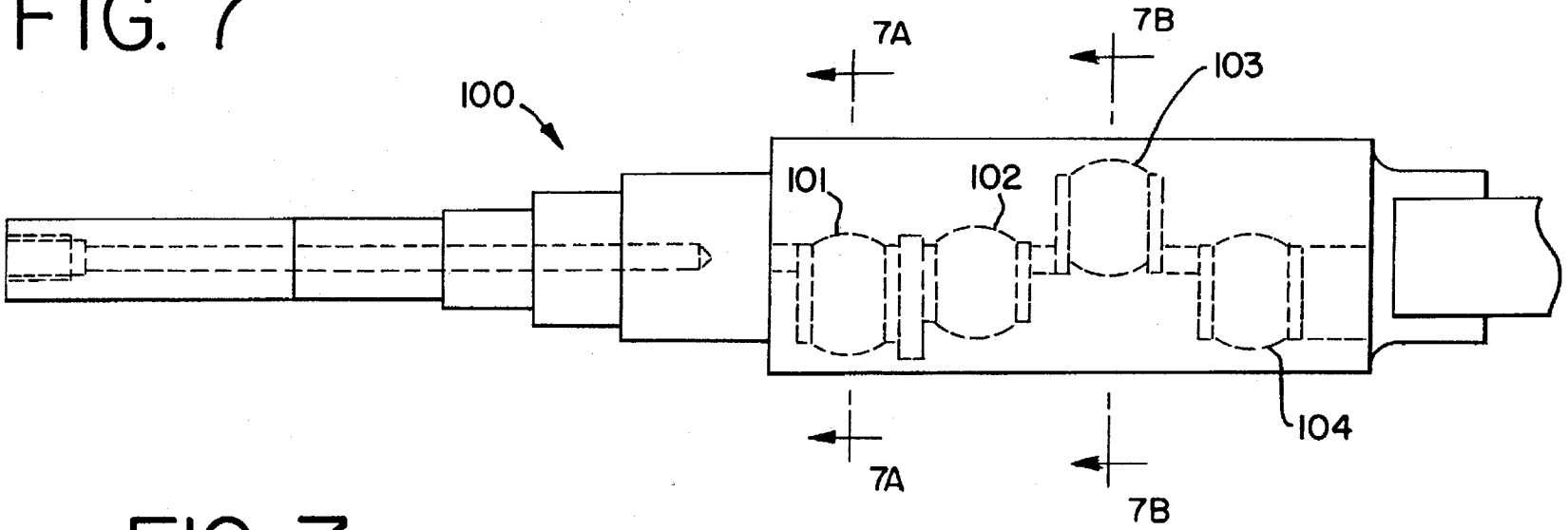
FIG. 7(*a, b*) depicts a portion of the crankshaft for one embodiment of the invention.
Figure 7B:
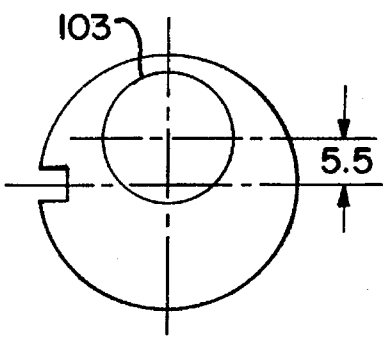
Figure 7A:
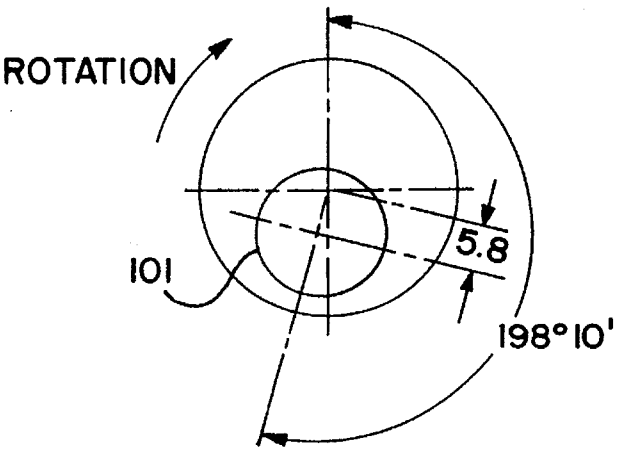

The preferred method for obtaining advanced timing used by the invention is to alter the lower looper drive on the crankshaft. FIG. 7 depicts portions of a crankshaft for an embodiment of the invention having a 26° advanced timing. In this embodiment, the crankshaft configuration is the same as the standard Juki MO configuration with the exception that the lower looper drive is modified. In FIG. 7, crankshaft 100 contains lower looper drive eccentric 101, knife drive eccentric 102, needle drive eccentric 103 and upper looper drive eccentric 104. As indicated by section A—A, the lower looper drive eccentric 101 has an angle of eccentricity of 198° 10' in relation to the needle drive eccentric 103, and is positioned 5.8 mm off of the crankshaft centerline. In section B—B, the centerline of the needle drive eccentric is positioned 5.5 mm off of the crankshaft centerline.

While the embodiments discussed above have been used to describe the invention, it is to be understood that other aspects of the sewing operation not considered significant to an understanding of the invention have been omitted.

EXAMPLES

The invention was compared to a Juki MO 2404NB-004306 (serial no. 2000-512167) overseaming machine. The timing of the lower looper was advanced 26° with respect to the sewing needle for the invention; the timing of the Juki machine was synchronized. An overseam stitch was sewn into a light knit "T" shirt material at 8000 rpm, corresponding to setting of 12 stitches per inch, with several different sewing threads. The looper threads were balanced so the purl was in the center while sewing over six plies of material.

Thread tensions and thread consumptions were measured and are listed in Table 2. The invention required needle thread tensions out of tension assembly in the range of 0.4 to 1.0 ounces. In contrast, the Juki overseaming machine required needle thread tensions out of tension assembly in the range of 1.0 to 3.2 ounces for the same threads and sewing operation. In addition, a different balance of thread tensions was achieved by the invention when compared to the Juki machine. For the invention, the tension of the needle thread out of tension assembly was generally about 30% to 50% that of the tension of the lower looper thread, and about the same as the tension of the upper looper thread. It is believed that increased looper thread tension tends to assist in setting the stitch before the needle thread is set and the needle thread slightly wraps around the stitch tongue. Accordingly, the invention produces a flexible chain.

In comparison, the Juki machine needle thread tension out of tension assembly was about 200% to 500% greater than the tension of the lower looper thread, and between about 50% to 500% that of the tension of the upper looper thread.

Overall, the needle thread tension for the invention averaged about 37% less than the looper thread tensions, while that of the Juki needle thread averaged about 160% heavier than the looper thread tensions. In addition, the needle thread tension out of assembly was about 130% lighter, and out of the last eyelet before the needle was about 215% lighter on the invention than on the Juki machine.

The needle thread was also observed to contact the needle thread cam 47% of the time for the invention and 100% of the time for the Juki machine. (See FIG. 4.)

The seam quality for the invention had the desired tight needle thread and relaxed looper threads around the seam with the purl centered, and appeared the same for both machines. Thus, the invention produced a strong, soft and flexible overedge stitch with needle thread tensions substantially less than on the Juki machine. In addition, the overedge stitch produced by the invention was observed to have a 5% tighter needle thread and a slightly more relaxed chain than the overedge stitch from the Juki machine. Thus, the balance of the thread tensions achieved by the invention produces a superior overedge stitch.

TABLE 2

PRIOR ART vs. 26° ADVANCE TIMING 504 STITCH - TENSION AND THREAD CONSUMPTION CHART[1]

| MACHINE STYLE | | THREAD TENSION THRU LAST EYELET HOLE OF SEWING COMPONENT (LAST EYELET BEFORE NEEDLE)[2] | | | | | | THREAD TENSION OUT OF TENSION ASSEMBLY | | | THREAD CONSUMPTION IN 6 INCH SEAM | | |
|---|---|---|---|---|---|---|---|---|---|---|---|---|---|
| | | NEEDLE THREAD | NEEDLE THREAD | LOWER LOOPER | LOWER LOOPER | UPPER LOOPER | UPPER LOOPER | | | | | | |
| SERIAL NUMBER | TYPE OF THREAD & CONTROL USED | BOTTOM STROKE | BOTTOM STROKE | BOTTOM STROKE | TOP STROKE | BOTTOM STROKE | TOP STROKE | NEEDLE | LOWER LOOPER | UPPER LOOPER | NEEDLE | LOWER LOOPER | UPPER LOOPER |
| MO2404 STD. #2000-512167 | A&E WILDCAT PLUS TEXTURIZED POLY T-18[3] | 6.6 | 4.6 | 3.2 | 3.1 | 11.0 | 10.5 | 2.5 | 0.8 | 1.2 | 12.5 | 29.2 | 26.0 |
| 26° ADVANCE EV904 #1716968 | A&E WILDCAT PLUS TEXTURIZED POLY T-18 | 1.5 | 1.5 | 7.5 | 7.3 | 7.0 | 6.8 | 1.0 | 1.5 | 1.1 | 11.8 | 30.5 | 28.2 |
| 'MO' | AMERICAN THREAD TIGER 202 5-18 TEXTURIZED POLY | 3.5 | 3.0 | 2.0 | 2.1 | 6.2 | 6.0 | 1.0 | 0.5 | 0.7 | 13.1 | 28.0 | 28.5 |
| 26° ADV. | AMERICAN THREAD TIGER 202 5-18 TEXTURIZED POLY | 1.1 | 1.1 | 6.5 | 5.8 | 6.8 | 7.0 | 0.4 | 1.0 | 0.6 | 12.5 | 28.0 | 28.5 |
| 'MO' | MORGAN KNIT-TEXTURIZED POLY 1/150 UNIFI INC.[4] | 3.5 | 2.5 | 2.3 | 2.5 | 3.8 | 3.5 | 1.1 | 0.5 | 0.8 | CAN NOT UNRAVEL | | |
| 26° ADV. | MORGAN KNIT-TEXTURIZED POLY 1/150 UNIFI INC. | 1.8 | 1.8 | 4.2 | 4.8 | 6.0 | 7.0 | 0.6 | 1.2 | 0.6 | CAN NOT UNRAVEL | | |
| 'MO' | A&E PERMA CORE T-27 | 6.5 | 5.0 | 1.2 | 1.5 | 5.0 | 6.2 | 2.4 | 0.5 | 0.5 | 12.8 | 31.0 | 28.0 |
| 26° ADV. | A&E PERMA CORE T-27 | 1.8 | 1.8 | 5.5 | 5.0 | 8.0 | 6.0 | 0.9 | 1.5 | 1.2 | 12.7 | 32.0 | 29.0 |
| 'MO' | AMERICAN THREAD 100-2 TEX 24 SPUN SPECTRUM I POLY | 8.0 | 6.5 | 1.3 | 1.4 | 10.0 | 10.5 | 2.6 | 0.5 | 1.2 | 13.0 | 31.2 | 27.0 |
| 26° ADV. | AMERICAN THREAD 100-2 TEX 24 SPUN SPECTRUM I POLY | 2.0 | 2.1 | 6.5 | 6.0 | 6.3 | 6.0 | 1.0 | 1.9 | 1.1 | 11.8 | 31.0 | 27.5 |
| MO2404 STD. #2000-512167 | NEEDLE-AMER. THD. 100-2- T-24 SPECTRUM I - SPUN POLY U. LOOPER & LOWER LOOPER | 6.0 | 4.5 | 0.7 | 1.0 | 2.1 | 2.5 | 2.4 | 0.4 | 0.7 | 12.6 | 29.2 | 30.1 |
| 26° ADVANCE EV904 #1716968 | NEEDLE-AMER. THD. 100-2- T-24 SPECTRUM I - SPUN POLY U. LOOPER & LOWER LOOPER | 2.5 | 2.1 | 3.2 | 3.2 | 1.6 | 1.6 | 1.2 | 0.3 | 0.9 | 11.0 | 32.2 | 29.0 |

TABLE 2-continued

PRIOR ART vs. 26° ADVANCE TIMING 504 STITCH - TENSION AND THREAD CONSUMPTION CHART[1]

| MACHINE STYLE | | THREAD TENSION THRU LAST EYELET HOLE OF SEWING COMPONENT (LAST EYELET BEFORE NEEDLE)[2] | | | | | | THREAD TENSION OUT OF TENSION ASSEMBLY | | | THREAD CONSUMPTION IN 6 INCH SEAM | | |
|---|---|---|---|---|---|---|---|---|---|---|---|---|---|
| | | NEEDLE THREAD | NEEDLE THREAD | LOWER LOOPER | LOWER LOOPER | UPPER LOOPER | UPPER LOOPER | | | | | | |
| SERIAL NUMBER | TYPE OF THREAD & CONTROL USED | BOTTOM STROKE | BOTTOM STROKE | BOTTOM STROKE | TOP STROKE | BOTTOM STROKE | TOP STROKE | NEEDLE | LOWER LOOPER | UPPER LOOPER | NEEDLE | LOWER LOOPER | UPPER LOOPER |
| 'MO' | THREADS USA 70 T-27 COTTON | 9.0 | 7.5 | 2.5 | 3.0 | 11.0 | 9.0 | 3.2 | 1.0 | 2.0 | 12.7 | 32.1 | 29.0 |
| 26° ADV. | THREADS USA 70 T-27 COTTON | 2.5 | 2.8 | 7.0 | 7.0 | 5.8 | 5.3 | 1.5 | 1.8 | 1.3 | 12.6 | 32.0 | 32.1 |
| 'MO' | COATS & CLARK 70-2 T-30 | 6.7 | 5.5 | 1.5 | 1.5 | 8.5 | 9.5 | 3.2 | 0.7 | 1.6 | 12.8 | 32.5 | 30.7 |
| 26° ADV. | COATS & CLARK 70-2 T-30 | 2.2 | 2.2 | 6.3 | 6.5 | 6.9 | 6.4 | 1.3 | 1.8 | 1.2 | 12.1 | 32.1 | 31.5 |
| 'MO' | A&E COTTON 100-2 T-24 BLUEGRASS | 7.0 | 6.5 | 2.2 | 2.2 | 11.5 | 8.5 | 2.9 | 0.9 | 2.0 | 10.7 | 32.2 | 29.5 |
| 26° ADV. | A & E COTTON 100-2 T-24 BLUEGRASS | 3.1 | 2.9 | 8.0 | 7.9 | 8.0 | 7.0 | 1.5 | 2.0 | 1.5 | 10.8 | 30.6 | 32.6 |

[1]Light knit 'T' shirt material stitch sewn at 8000 rpm, stitch length 12 inches.
[2]All looper thread tensions measured through heel hole of looper.
[3]Needle thread breaks-6 ply.
[4]Needle thread breaks-6 ply.

I claim:

1. An overedge stitch sewing device comprising:

a sewing surface;

a crankshaft mounted for rotation on said device, said crankshaft including a needle eccentric, a lower looper eccentric and an upper looper eccentric that rotate with the crankshaft, said crankshaft having a zero degree reference point;

a straight sewing needle mounted on said device to reciprocate through a cycle, defining a reciprocating path, commencing from a position where the sewing needle is below said sewing surface to a mid point in the cycle where the sewing needle is above said sewing surface and then back to the starting point, said sewing needle being drivingly connected to said needle eccentric, said needle eccentric being secured to said crankshaft such that said sewing needle cycle commences at the zero degree reference point of the crankshaft;

a lower looper mounted on said device, below the sewing surface, for oscillation through a cycle describing an arc that crosses the reciprocating path of said sewing needle, said lower looper being drivingly connected to said lower looper eccentric, said lower looper eccentric being secured to said crankshaft such that said lower looper cycle commences prior to the cycle of said sewing needle, such that said lower looper has an advanced timing with respect to the sewing needle; and an upper looper mounted on said device for oscillating movement through a cycle from below the sewing surface to above the sewing surface, said upper looper being drivingly connected to said upper looper eccentric, said upper looper eccentric being connected to said crankshaft such that said upper looper cycle commences at the same time as the cycle of said sewing needle.

2. The sewing device of claim 1 wherein said needle eccentric and said lower looper eccentric are secured to said crankshaft such that the timing of the lower looper when measured in degrees of rotation of the crankshaft is advanced between about 15° and 35° with respect to the sewing needle.

3. The sewing device of claim 1 wherein said needle eccentric and said lower looper eccentric are secured to said crankshaft such that the timing of the lower looper when measured in degrees of rotation of the crankshaft is advanced about 26° with respect to the sewing needle.

4. The sewing device of claim 1 further comprising a thread tensioner mounted on said device for applying tension to the needle thread and an arc-shaped needle thread cam mounted on said device between said thread tensioner and said sewing needle, said arc-shaped needle thread cam having a contour and the thread paths between said thread tensioner and said arc-shaped needle thread cam and between said arc-shaped needle thread cam and said sewing needle being such that, during a needle stroke in a sewing operation, needle thread is in contact with the arc-shaped needle thread cam for less than the entire reciprocating cycle of said sewing needle.

5. The sewing device of claim 4 wherein, during a reciprocating cycle of a needle stroke in a sewing operation, needle thread contacts the needle thread cam approximately 50% of the time required to complete the reciprocating cycle.

* * * * *